US005684517A

United States Patent [19]

Clemente et al.

[11] Patent Number: 5,684,517

[45] Date of Patent: Nov. 4, 1997

[54] METHOD OF DOT PRINTING AND CORRESPONDING INK JET PRINT HEAD

[75] Inventors: Alcide Clemente, Borgofranco d'Ivrea; Alessandro Scardovi, Ivrea, both of Italy

[73] Assignee: Olivetti-Cannon Industriale S.p.A., Ivrea, Italy

[21] Appl. No.: 288,046

[22] Filed: Aug. 10, 1994

[30] Foreign Application Priority Data

Aug. 19, 1993 [IT] Italy ..... TO93A0622

[51] Int. Cl.[6] ..... B41J 2/21; B41J 2/205

[52] U.S. Cl. ..... 347/43; 347/15

[58] Field of Search ..... 347/43, 41, 104, 347/15, 40

[56] References Cited

U.S. PATENT DOCUMENTS

| | | | |
|---|---|---|---|
| 4,528,576 | 7/1985 | Koumura et al. . | |
| 4,748,453 | 5/1988 | Lin et al. . | |
| 4,855,752 | 8/1989 | Bergstedt . | |
| 4,963,882 | 10/1990 | Hickman . | |
| 4,967,203 | 10/1990 | Doan et al. . | |
| 4,999,646 | 3/1991 | Trask . | |
| 5,225,849 | 7/1993 | Suzuki et al. | 347/14 |
| 5,376,958 | 12/1994 | Richtsmeier et al. | 347/43 |
| 5,455,610 | 10/1995 | Harrington | 347/43 |

FOREIGN PATENT DOCUMENTS

| | | | |
|---|---|---|---|
| 3412531 | 10/1985 | European Pat. Off. | 347/43 |
| 401575 | 5/1990 | European Pat. Off. | 347/43 |

*Primary Examiner*—Benjamin R. Fuller
*Assistant Examiner*—Thinh Nguyen
*Attorney, Agent, or Firm*—Banner & Witcoff, Ltd.

[57] ABSTRACT

A method of color printing with an ink jet printing head adapted to print one strip for each color and comprising nozzles disposed in distinct groups (22) for each color, with a different number of nozzles from group to group. Each group is separated from the subsequent group by intervals (DCM, DMY) of different magnitude. The method consists of printing strips of a subsequent color only after having printed at least two strips of a first color and superimposing each subsequent color on the first of the two strips printed previously.

23 Claims, 3 Drawing Sheets

| NO. PASSES / COLOR | 1 | 2 | 3 | 4 | 5 | 6 | 7 | 8 | 9 | 10 | 11 | 12 | 13 |
|---|---|---|---|---|---|---|---|---|---|---|---|---|---|
| CYAN | 1-16 | 1-16 | 1-16 | 1-16 | 1-16 | 1-16 | 1-16 | 1-16 | 1-16 | | | | |
| MAGENTA | | | 1-17 | 2-17 | 2-17 | 2-17 | 2-17 | 2-17 | 2-17 | 2-17 | 2-16 | | |
| YELLOW | | | | | 1-18 | 3-18 | 3-18 | 3-18 | 3-18 | 3-18 | 3-18 | 3-18 | 3-16 |

METHOD OF DOT PRINTING AND CORRESPONDING INK JET PRINT HEAD

FIELD OF THE INVENTION

The present invention relates to a method of dot printing and to the corresponding ink jet printing head, and more particularly, to a method for improving the perceptible printing quality of graphic images and alphanumeric texts obtained with both black-and-white and colour printing.

The dot printing method according the present invention may be applied indiscriminately to any type of ink jet head, and preferably it is applied to a thermal colour ink jet printing head.

BACKGROUND OF THE INVENTION

From European Patent No. 300 595 there is a known printing method of the above indicated type, in which the printing head contains several nozzles, fed in groups with ink of various colours, for example, Cyan, Yellow, and Magenta.

The head is transported in two opposing directions in front of a printing medium, on which the ink drops are deposited in successive passes.

During a first pass a strip of a first colour is deposited, Cyan, for example, on which is deposited a second strip of a second colour, Yellow for example, in a second pass, but staggered in defect i.e. with a width less than that of the previous strip, while a next strip of the first colour is deposited alongside the first, with equal width.

In successive passes, strips of the first and the second colour are alternately deposited, of which the strip of the second colour is always staggered in defect of the same quantity with respect to that of the first colour.

If printing is done in this way, making use of two successive back and forth runs of the head, the ink of the first pass is not yet sufficiently dry when the ink of the second colour is superimposed on it, so that the latter mixes with the underlying ink in an irregular fashion, creating perceptible spots of colour, to the detriment of the print quality.

SUMMARY OF THE INVENTION

Preferred embodiments of the present invention seek to print, with colour inks, images of high quality, having none of the inconveniences mentioned above.

One embodiment of the present invention prints graphic images and alphanumeric texts by depositing an ink of a second colour on top of an ink of a first colour after a sufficient time to allow the first-deposited ink to dry and not mix with the ink deposited afterwards.

Another embodiment of the present invention covers with a successive pass a white zone that may be situated between two adjacent strips, having been left untouched by ink due to possible errors in the feed of the printing medium, for example, a sheet of paper.

The invention is defined in the appended claims to which reference should now be made.

This and other characteristics of the invention will appear more clearly from the following description of a new printing method and a preferred embodiment of the new printing head, making reference to the attached drawings and diagrams.

DETAILED DESCRIPTION OF PREFERRED EMBODIMENTS

Figure 1A:
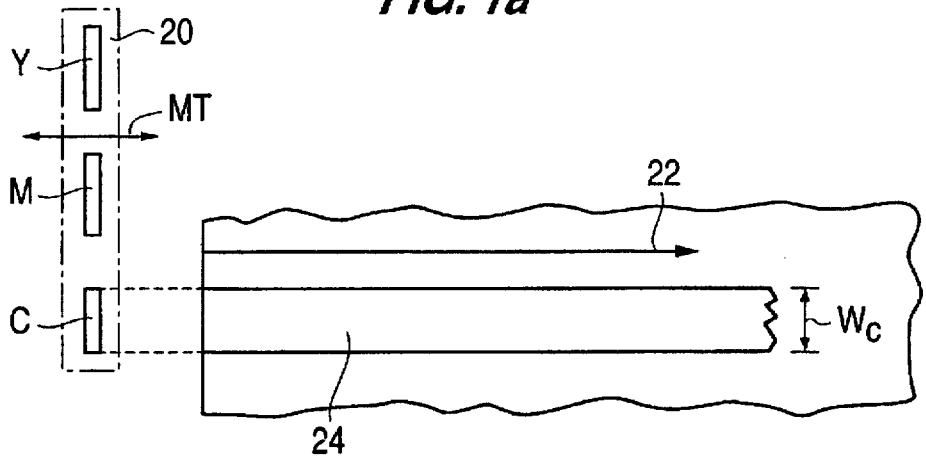
FIGS. 1*a–e* show the successive phases of a printing method embodying the invention, for printing with two and/or three different colours.
Figure 1B:
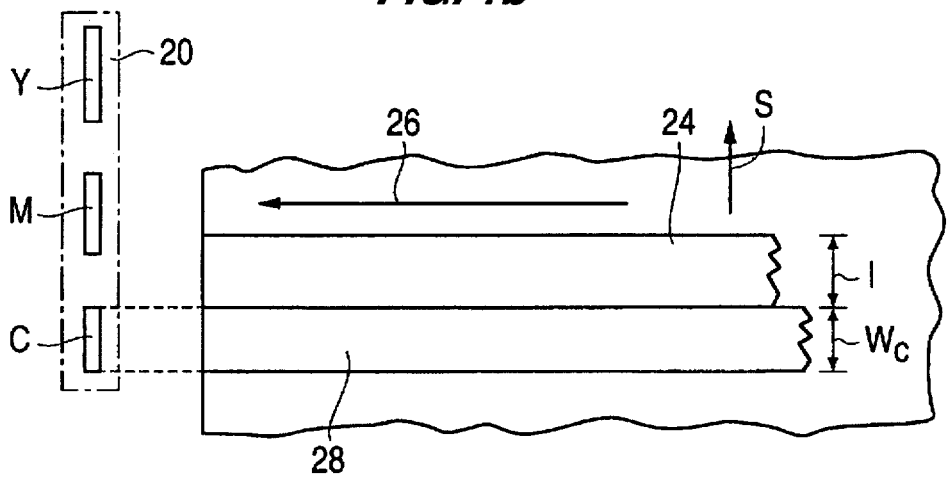
Figure 1C:
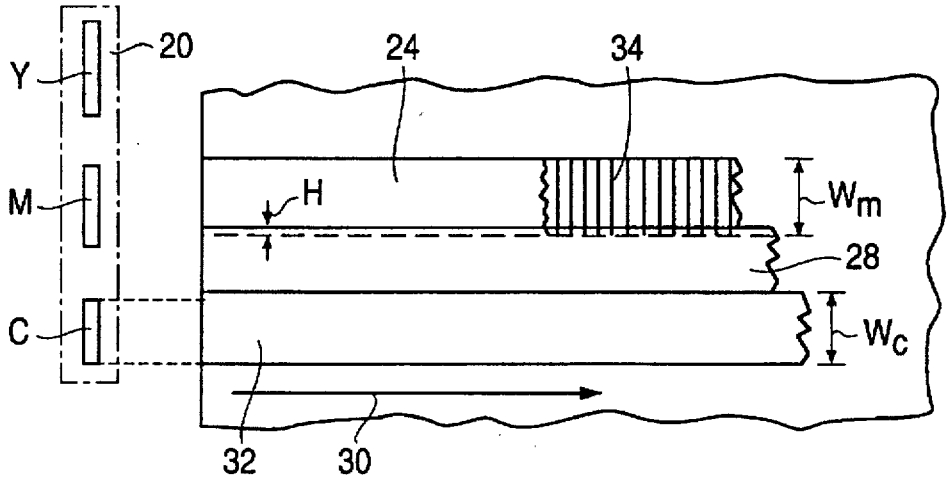
Figure 1D:
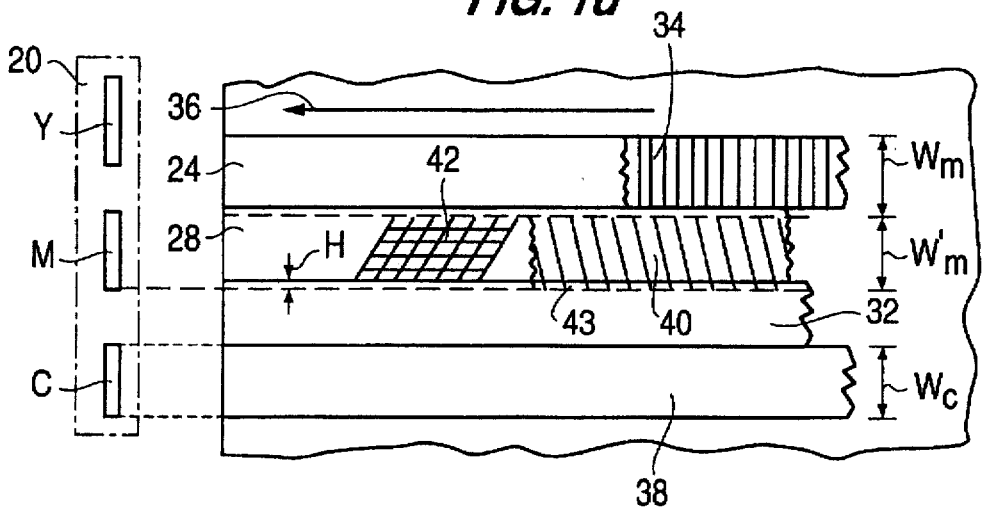
Figure 1E:
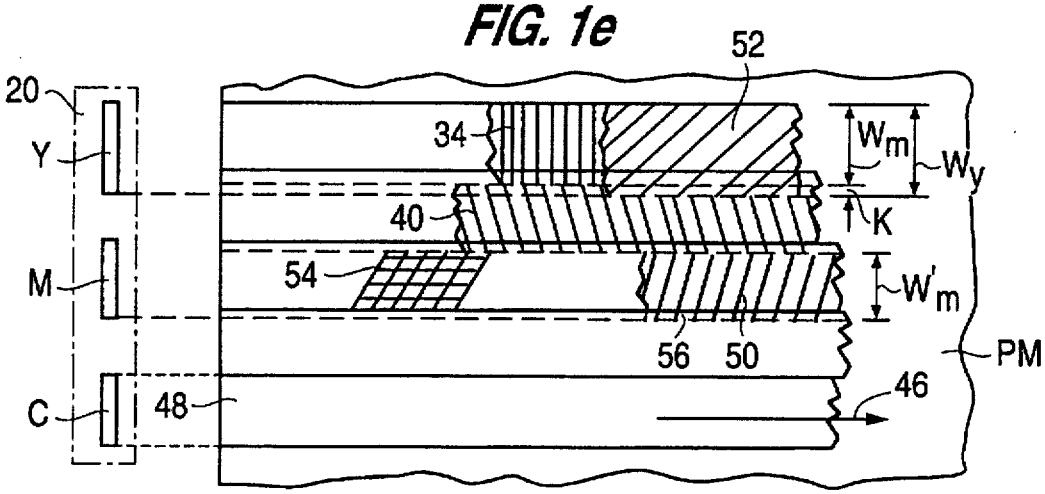
Figures 2, 3:
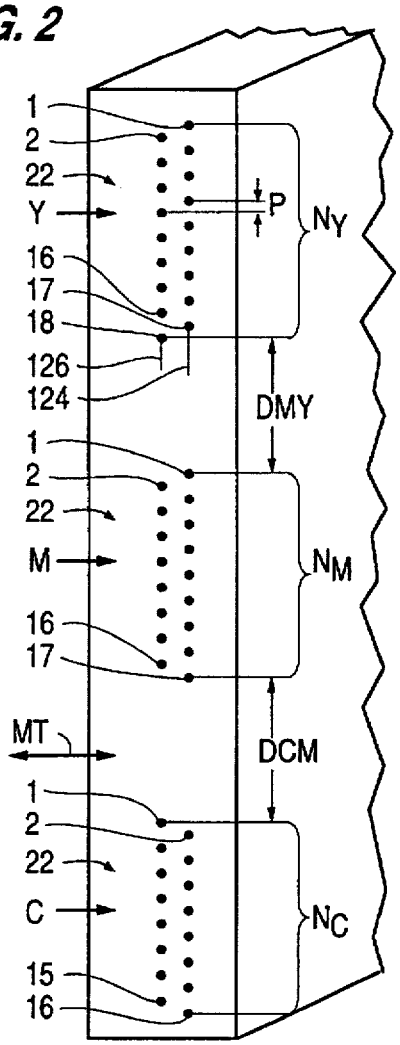
FIG. 2 shows an ink jet printing head suitable for printing according to the method of FIG. 1.
FIG. 3 shows a table indicating the number of nozzles for each colour of the printing head of FIG. 2, as used in the successive passes.

With respect to FIGS. 1*a–e*, on the lefthand side, there is a diagram of the arrangement of the nozzles of the head 20 used in the present invention and described more closely hereafter with respect to FIG. 2.

In brief, the head 20 contains three groups of nozzles, indicated by C, M, Y, respectively referring to the three basic colours Cyan, Magenta, and Yellow. The head 20 is mounted on a carriage, moved by its own motor, not shown in the drawings, in two opposite directions, i.e. a forward run and a return run, also known as passes, to deposit drops of ink on a printing medium PM to form a strip.

By strip is meant a band or stripe of a certain colour, extending for the whole or part of the run of the head and deposited by emission of ink through all or part of the nozzles of each group.

After each pass, the printing medium is moved by an interlinear distance I in a direction S perpendicular to the direction MT of movement of the head 20 (and, thus, to the printing line). The method of dot printing according to the invention comprises the following phases:

Phase a): during a first pass 22 (FIG. 1*a*), the nozzles C deposit a strip 24 of a first colour, for exemple Cyan, of width Wc.

Phase b): during a second pass 26 (FIG. 1*b*), the nozzles C deposit a second strip 28 of the first colour, adjacent to the first strip 24, of width Yc.

The second pass 26 can be made during the return run of the head, in a direction opposite to the first pass, or in a successive run in the same direction as the first pass, after an idle run. According to a preferred embodiment of the present method, but not limited hereto, the head performs the printing in the forward and return runs, without performing any idle runs, in order to increase as much as possible the overall printing speed.

Phase c): during a third pass 30 (FIG. 1*c*), the nozzles C deposit a third strip 32 of the same first colour, of width Wc, adjacent to the second strip 28, and at the same time the nozzles M deposit a first strip 34 of a second colour, Magenta for example, of width Wm, greater than the width Wc, totally covering the first strip 24 and only partially the second strip 28 of the first colour. The width Wm of the strip 24 of the second colour exceeds, by a predetermined quantity H, the width Wc of the first strip 24 beneath it. Therefore, the expression holds:

$$Wm=Wc+H$$

The quantity H is equal at least to the distance p (elementary pitch) between two consecutive nozzles (FIG. 2) of each group, measured in the direction of alignment of the nozzles themselves.

Phase d): during a fourth pass 36 (FIG. 1*d*), a fourth strip 38 of the first colour, of width Wc, is deposited adjacent to the third strip 32, and at the same time a second strip 40 of the second colour, this time of width W'm equal to the width Wc of the strips of the first colour, is deposited adjacent to the preceding strip 34 of the same colour and totally covering the portion 42 of the second strip 28 of the first colour that has remained uncovered, and a part 43 of the third strip 32 of the first colour.

In this way, it is clear that, since W'm=Wc, the second strip 40 of the second colour overflows the third strip 32 of the first colour by the quantity H.

Phase e): during a fifth pass 46 (FIG. 1*e*), there are simultaneously deposited: a fifth strip 48 of the first colour of width Wc, adjacent to the fourth strip 32; a third strip 50 of the second colour, of width W'm, adjacent to the preceding strip 40 of the same second colour; and a first strip 52 of a third colour, Yellow for example, of width Wy, greater than the width W'm (and thus, also greater than the width Wc) and totally covering the first strips 24, 34 of the first and the second colour, and only partially the second strips 28, 40 of the first and the second colour. In this fifth pass 46, the third strip 50 of the second colour is superimposed, as in the previous phase, on the part 54 remaining uncovered of the underlying strip of the first colour and a part 56 of the fourth strip 32 of the first colour.

The width Wy of the first strip 52 of the third colour exceeds, in this fifth pass, the width Wm by at least a quantity K, for which the relation now holds:

$$Wy=Wm+K=Wc+H+K$$

where K can be equal to or greater than H.

Figure 1F:
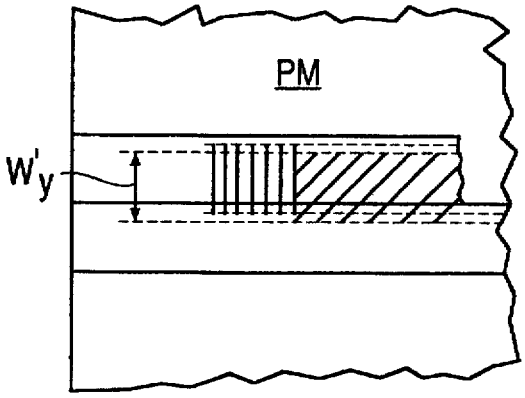
FIG. 1*f* shows an intermediate phase in the printing with three colours.

In each of the successive passes, three strips of the three colours Cyan, Magenta, and Yellow are simultaneously deposited by the methods indicated for the fifth pass,; except that the strips of the third colour, Yellow, have a width W'y=Wc (FIG. 1*f*).

Figure 1G:
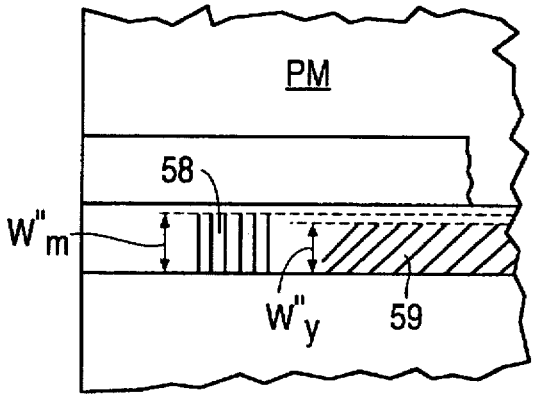
FIG. 1*g* shows a final phase of the printing with three colours.

At the end of the printing of a colour image, according to the method of the present invention as described above, the last strip 58 (FIG. 1*g*) of the second colour will have a width W'm decreased by the quantity H with respect to the width Wc, while the width of the last strip 59 of the third colour will have a width W'y, decreased by (H+K).

As will be easily observed, the method specifies that each subsequent colour is deposited only after the second pass with respect to the colour previously deposited, so as to allow the latter to dry sufficiently. In fact, the second colour is deposited on top of the first only during the third pass of the printing head (FIG. 1*c*), while the third colour is deposited on top of the second in the fifth pass of the head (FIG. 1*e*).

In this way, any disuniformity in the mixing of the colours is eliminated, so that the formation of intermediate colours or hues occurs in a very regular way over the entire surface covered thus eliminating spots of different colouration.

FIG. 2 shows, in schematic fashion, the new arrangement of the nozzles of an ink jet printing head 20, particularly adapted to colour printing of graphic images and alphanumeric text of high print quality, so that each subsequent colour is superimposed on a different, preceding, colour, to form all the desired intermediate shades, without creating noticeable spots or haloes.

The head 20 contains a number of nozzles 22. The nozzles 22 communicate with ink expulsion chambers (not shown), in which a pressure impulses is generated by any of the methods familiar to the art for expelling ink drops from the corresponding nozzles.

In the following description we shall refer to an ink jet head of thermal type, although other types of ink jet heads can also be used.

The nozzles 22 are arranged in groups, each group being fed with ink of a different colour.

In a preferred embodiment, but not limited hereto, the nozzles 22 are subdivided into three groups, respectively indicated C, M, Y, with reference to three inks of different colour, Cyan, Magenta and Yellow.

The nozzles of each group are aligned in two columns 124 and 126, parallel to the direction S of feed of the printing medium, and therefore the two columns 124 and 126 are perpendicular to the direction of movement of the head, indicated by MT.

The nozzles 22 can also be arranged in a single column, or distributed in more than two columns, however.

The nozzles of adjacent columns are staggered in the direction S by a quantity equal to the pitch p, while the groups of nozzles are spaced by a distance that varies from one group to another, as shall be explained hereafter.

Moreover, each group contains a number of nozzles that is different from that of the other groups.

Indicating by I the width of an interlinear spacing, expressed in number of pitches p, the distribution of the nozzles 22 satisfies the following expressions; NC=I+1; NM=I+1+H; NY=I+1+H+K $$DCM=I+1-H \text{ (pitches)}$$

$$DMY=I+1-(H+K)\text{(pitches)}$$

where:

NC is the number of nozzles of group C (Cyan);

NM is the number of nozzles of group M (Magenta);

NY is the number nozzles of group Y (Yellow);

DCM is the distance between the groups C and M;

DMY is the distance between the groups M and Y, expressed in number of pitches p (normally, p is equal to 1/300"), and having (H, K=1,2, . . . ).

In the case when I=15 (pitches p) and H=K=1, the number of nozzles of the groups C, M, Y are respectively;

NC=16; NM=17; NY=18;

and the spacings between the groups C and M and between the groups M and Y are respectively:

DCM=15 (pitches p); DMY=14 (pitches p).

With the numerical values calculated above, it is easy to determine how the printing method should operate.

The first strip of Cyan, printed with the 16 nozzles of the group C, has a width of Wc=15/300". After an interlinear spacing I=15/300", the second strip of Cyan is printed with the 16 nozzles C, being adjacent to the previous strip.

In the third pass, after another interlinear spacing of 15/300", the nozzles C print another strip of Cyan adjacent ot the preceding one, while the 17 nozzles M print a strip of colour Magenta, of width Wm=16/300", for which the 17th nozzle prints on top of a portion of the second strip of Cyan, in a width exceeding 1/300".

Continuing with the printing and using interlinear spacings of 15/300", we reach the fifth pass, in which the 18 nozzles of the group Y (Yellow) print a strip of width Wy=17/300", which is superimposed on the first strip of Cyan+Magenta,, overflowing onto the second strip by 2/300", with respect to the width Wc.

In the intermediate passes, the strips of the second and third colour are staggered forward with respect to the strips of the first colour.

The table of FIG. 3 shows, as an example, the sequence number of the nozzles of each group used for the colour printing of a hypothetical image with 13 passes.

It is understood that additions or modifications can be made in the method and the head embodying to the present invention, without leaving the framework of the latter.

What it is claimed is:

1. A method of printing an image on a printing medium with an ink jet printing head reciprocatable along a scanning direction substantially orthogonal to a feed direction of the printing medium in order to perform a sequence of passes, said head having groups of nozzles for printing strips with ink of correspondingly different colours on said printing medium during said passes, said different colours comprising a first colour and at least one subsequent colour, the method comprising the steps of:

printing a first strip of said first colour during a first pass of the head across the printing medium;

printing a second strip of said first colour adjacent to said first strip during a second pass of the head across the printing medium;

printing a third strip of said first colour adjacent to said second strip during a third pass of the head across the printing medium and simultaneously printing a first strip of said at least one subsequent colour on said first strip of said first colour, said first strip of said at least one subsequent color having a greater width than a width of said first strip of said first color and overflowing on to said second strip of said first colour by a predetermined quantity (H), whereby shades of colour are formed in a substantially regular manner over said printing medium.

2. A method according to claim 1, wherein said predetermined quantity (H) is at least equal to a distance (p) measured between two consecutive nozzles in said feed direction.

3. A method according to claim 1, wherein said width of said first strip of said first colour is equal to a distance between a first and a last nozzle of a group of said groups of nozzles for printi-ng a strip with ink of said first colour.

4. A method according to claim 1, wherein said different colors are Cyan, Magenta and Yellow.

5. A method of colour printing with an ink jet printing head including separate groups of nozzles, in which each group of said groups of nozzles prints a strip of a different colour on a printing medium advanced intermittently in a feed direction by an interlinear spacing of predetermined magnitude, comprising the following steps:

a) printing a first strip of a first colour;

b) printing a second strip of said first colour adjacent to said first strip of said first colour;

c) printing a third strip of said first colour adjacent to said second strip of said first color and a first strip of a second colour totally superimposed upon said first strip of said first colour and overflowing on to said second strip of said first colour by a first quantity (H);

d) printing a fourth strip of said first colour adjacent to said third strip of said first color and a second strip of said second colour adjacent to said first strip of said second colour, superimposed upon said second strip of said first colour and overflowing on to said third strip of said first colour by said first quantity (H);

e) printing a fifth strip of said first colour adjacent to said fourth strip of of said first colour, a third strip of said second colour adjacent to said second strip of said second colour and superimposed upon said third strip of said first colour and overflowing on to said adjacent fourth strip of said first colour by said first quantity (H), and a strip of a third colour totally superimposed upon said first strip of said second colour and overflowing on to said second adjacent strip of said second colour by a second quantity (K).

6. A method according to claim 5, wherein said first and second quantities (H, K) are equal, independently of one another, to an integral multiple of the distance between two consecutive nozzles, measured in said feed direction.

7. A method according to claim 5, wherein a width of said strip of said first colour is equal to a distance between first and last nozzles of a group of said groups of nozzles for printing a strip with ink of said first colour.

8. A method according to claim 7, wherein a width of a first of said strip of said second colour exceeds said width of said first strip of said first colour by said first quantity, and wherein a width of a first of said strip of said third colour exceeds said width of said first strip of said first colour by said second quantity.

9. A method according to claim 8, wherein a width of strips of said second and third colours other than said first strips is equal to said width of said strips of said first colour.

10. A method according claim 5, wherein said groups of nozzles comprise a different number of nozzles from one another.

11. A method according to claim 10, wherein said nozzles of each group are aligned in said feed direction and are arranged at integrals of a constant magnitude (p) in said feed direction.

12. A method according to claim 11, wherein said group of nozzles fed with said first colour comprises as many nozzles as are included in the magnitude of said interlinear spacing, said nozzles being arranged at intervals of said constant magnitude (p) in said feed direction.

13. A method according to claim 5, wherein said printing head comprises a first, a second and a third group of nozzles and a distance between said first and said second group is different from a distance between said second and said third group of nozzles.

14. A method according to claim 1, in which said printing medium advances in said feed direction by an interlinear spacing of a predetermined magnitude, wherein a distance between first and last nozzle of said group of nozzles fed with ink of said first colour is equal to said predetermined magnitude of said interlinear spacing.

15. A method according to claim 13, wherein a distance between first and last nozzles of said second group of nozzles is equal to the corresponding distance between first and last nozzles of said first group, increased by said first quantity, and wherein a distance between first and last nozzles of said third group of nozzles is equal to said corresponding distance of said first group, increased by a sum of said first and said second quantities.

16. A method according to claim 13, wherein said distance between said first and said second group of nozzles is equal to the magnitude of said interlinear spacing reduced by said first quantity, and the distance between said second and said third group of nozzles is equal to the magnitude of said interlinear spacing reduced by the sum of said first and second quantities.

17. An ink jet dot printing head for printing data on a printing medium advanced intermittently in a feed direction by an interlinear spacing of predetermined magnitude, said head comprising a plurality of nozzles for ink emission, said nozzles being spaced in said feed direction by a pitch of constant magnitude, and disposed in groups arranged in columns aligned along a common axis substantially parallel to said feed direction, wherein said groups are arranged at intervals of different magnitude from one another, and each of said groups comprises a different number of nozzles from one another.

18. A head according to claim 17, wherein said intervals comprise different multiples of the said pitch of constant magnitude.

19. A head according to claim 17, wherein said head comprises a first, a second and a third group of nozzles, each of said first, second third group being fed with an ink of a different colour.

20. A head according to claim 19, wherein said first group of nozzles fed with an ink of a first colour comprises as many nozzles as are included in said interlinear spacing.

21. A head according to claim 19, wherein said second group of nozzles fed with ink of a second colour and adjacent to said first group comprises a number of nozzles equal to the number of nozzles of said first group increased by at least one nozzle.

22. A head according to claim 20, wherein said third group of nozzles fed with ink of a third colour and adjacent to said second group comprises a number of nozzles equal to number of nozzles of said second group increased by at least one nozzle.

23. A head according to claim 17, wherein the distance between said first and said second group of nozzles is equal to the magnitude of said interlinear spacing reduced by at least one pitch, and the distance between said second and said third group of nozzles is equal to the distance between said first and second groups reduced by at least one pitch.

* * * * *

UNITED STATES PATENT AND TRADEMARK OFFICE

CERTIFICATE OF CORRECTION

PATENT NO. : 5,684,517

DATED : November 4, 1997

INVENTOR(S) : Alcide Clemente and Alessandro Scardovi

It is certified that error appears in the above-identified patent and that said Letters Patent is hereby corrected as shown below:

On title page, item [73] Assignee: delete "Olivetti-Cannon" and insert --Olivetti-Canon--.

Signed and Sealed this

Sixteenth Day of June, 1998

*Attest:*

*Attesting Officer*

Bruce Lehman

BRUCE LEHMAN

*Commissioner of Patents and Trademarks*